US009619987B2

(12) United States Patent
Desgorces et al.

(10) Patent No.: US 9,619,987 B2
(45) Date of Patent: Apr. 11, 2017

(54) FLOOR COVERING

(75) Inventors: Claude Desgorces, Gujan Mestras (FR); Dominique Henault, Tigy (FR)

(73) Assignee: ABCD INNOVATION, Paris (FR)

( * ) Notice: Subject to any disclaimer, the term of this patent is extended or adjusted under 35 U.S.C. 154(b) by 332 days.

(21) Appl. No.: 14/237,917

(22) PCT Filed: Aug. 2, 2012

(86) PCT No.: PCT/FR2012/000327

§ 371 (c)(1),
(2), (4) Date: Mar. 27, 2014

(87) PCT Pub. No.: WO2013/024212

PCT Pub. Date: Feb. 21, 2013

(65) Prior Publication Data

US 2014/0215928 A1 Aug. 7, 2014

(30) Foreign Application Priority Data

Aug. 12, 2011 (FR) ..... 11 02512

(51) Int. Cl.
*G08B 23/00* (2006.01)
*G08B 21/04* (2006.01)
(Continued)

(52) U.S. Cl.
CPC ..... *G08B 21/0438* (2013.01); *E04B 5/00* (2013.01); *E04F 15/00* (2013.01); *E04F 19/00* (2013.01);
(Continued)

(58) Field of Classification Search
CPC ..... G08B 13/043; G08B 13/0461; G08B 21/0438; G08B 13/10
See application file for complete search history.

(56) References Cited

U.S. PATENT DOCUMENTS 6,515,586 B1 * 2/2003 Wymore ..... G08B 13/10 307/116
6,707,386 B1 * 3/2004 Pruisner ..... G08B 13/10 307/116
(Continued)

FOREIGN PATENT DOCUMENTS

EP 0 358 587 3/1990
FR 2 415 844 8/1979
(Continued)

OTHER PUBLICATIONS

International Search Report dated Oct. 11, 2012, corresponding to PCT/FR2012/000327.

*Primary Examiner* — Ryan Sherwin
(74) *Attorney, Agent, or Firm* — Troutman Sanders LLP

(57) ABSTRACT

A floor covering includes: a surface layer having a plurality of conductive segments capable of being supplied with electrical power; an at least partially electrically insulating intermediate layer having a plurality of through-recesses distributed in a substantially regular manner so that the mean distance between a recess and the recess closest thereto is between approximately 5 and 20 cm; a base layer having a plurality of electrical contacts, of which at least some correspond to the recesses of the surface layer and are connected to an electronic controller; the surface, intermediate and base layers being superimposed in this order and positioned so that at least some of the conductive segments are arranged at least partially opposite a recess of the intermediate layer, and so that these conductive segments react to a pressure by approaching the electrical contacts which correspond to the base layer.

18 Claims, 1 Drawing Sheet

Figure 1:
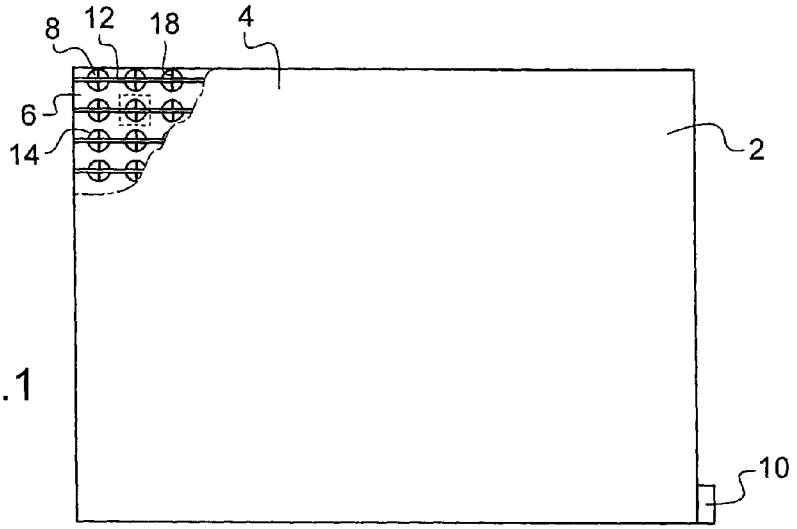

(51) Int. Cl.

| | |
|---|---|
| ***E04B 5/00*** | (2006.01) |
| ***E04F 15/00*** | (2006.01) |
| ***E04F 19/00*** | (2006.01) |
| *G08B 13/10* | (2006.01) |

(52) U.S. Cl.
CPC ..... *G08B 21/043* (2013.01); *G08B 21/0461* (2013.01); *G08B 13/10* (2013.01)

(56) References Cited

U.S. PATENT DOCUMENTS

| | | | | |
|---|---|---|---|---|
| 6,965,311 | B1 * | 11/2005 | Karner ..... | G08B 21/22<br>200/85 R |
| 7,382,267 | B2 * | 6/2008 | Brendley ..... | G08B 13/10<br>340/541 |
| 2002/0014968 | A1 | 2/2002 | Fitzgerald | |
| 2010/0194525 | A1 | 8/2010 | Do et al. | |
| 2010/0316253 | A1 * | 12/2010 | Yang ..... | G08B 21/0423<br>382/103 |

FOREIGN PATENT DOCUMENTS

| | | |
|---|---|---|
| GB | 342 157 | 1/1931 |
| GB | 1 209 564 | 10/1970 |
| JP | 3 275039 | 12/1991 |
| JP | 2008 257513 | 10/2008 |

* cited by examiner

FLOOR COVERING

BACKGROUND OF THE INVENTION

Field of the Invention

The invention relates to the field of floor coverings, and more specifically floor coverings which are capable of detecting that a person has fallen.

Description of the Related Art

All developed countries are experiencing an increased ageing of their populations. This ageing can be seen in a very sharp increase of the number of people aged 60 and over. This situation creates a real challenge in the field of public health. It also creates serious problems in the management of the dependency of elderly people.

This is because elderly people are seeing their life expectancy increase every year. Furthermore, the development of social structures results in these people leading a more and more solitary existence, or living within specialised structures.

For people living alone, this isolation is an acute problem since they are at risk of dying of the consequences of a fall owing to an inability to call for assistance. In the case of specialised structures, the detection of falls is also very important, if it is desirable to avoid a very high number of care staff, with a very high cost for providing care, and cases of litigation regarding responsibility for lack of supervision.

The increasing awareness of these problems has resulted in studies being carried out which have shown that more than 7500 people die each year in France as a result of a fall which has not been detected in time, or from the consequences of a fall which has not been dealt with in a timely manner.

Currently, there is no device which provides a truly satisfactory solution for the detection of persons falling within their everyday environment.

SUMMARY OF THE INVENTION

The invention is intended to improve the situation.

To this end, the invention proposes a floor covering which comprises:

- a surface layer which comprises a plurality of conductive segments which are capable of being supplied with electrical power,
- an intermediate layer which is at least partially electrically insulating and which comprises a plurality of through-recesses which are distributed in a substantially regular manner so that the mean distance between a recess and the recess to which it is closest is between approximately 5 cm and 20 cm,
- a base layer which comprises a plurality of electrical contacts, of which at least some correspond to the recesses of the surface layer and which are connected to an electronic controller,
- the surface layer, the intermediate layer and the base layer being superimposed in this order and positioned so that at least some of the conductive segments are arranged at least partially opposite a recess of the intermediate layer, and so that these conductive segments react to a pressure by approaching corresponding electrical contacts of the base layer, the electronic controller further being arranged to selectively transmit a warning signal, in accordance with a condition which comprises the number of conductive elements to which it is connected which are adjacent to a conductive segment.

BRIEF DESCRIPTION OF THE DRAWING FIGURES

Figure 3:
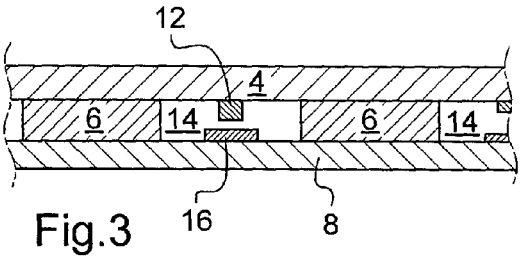
Figure 2:
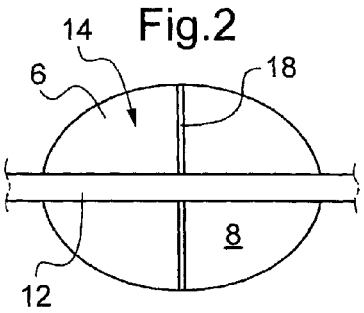
Figure 4:
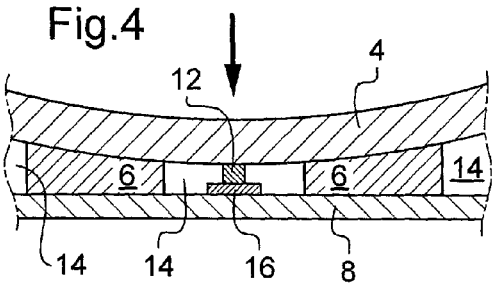
Figure 5:
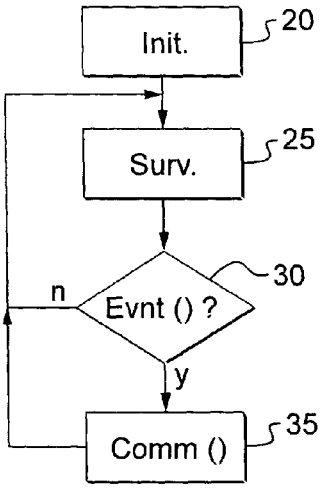

Other features and advantages of the invention will be better appreciated from a reading of the following description, taken from examples which are given by way of non-limiting illustration and taken from the drawings, in which:

FIG. 1 is a view with the covering according to the invention being partially broken away, FIG. 2 is a close-up view of a portion of FIG. 1, FIG. 3 is a sectioned view of FIG. 2, FIG. 4 is a view similar to the view of FIG. 3 when the covering is subjected to pressure, and FIG. 5 is an example of a flow chart of an operation implemented in the invention.

DETAILED DESCRIPTION OF THE INVENTION

The following drawings and description contain, for the most part, elements of a specific nature. They will therefore be able not only to serve to provide better understanding of the invention, but also to contribute to the definition thereof, where applicable.

As can be seen in FIG. 1, a floor covering 2 comprises a surface layer 4, an intermediate layer 6, a base layer 8 and an electronic controller 10.

In order to better show all these elements, FIGS. 1 to 4 will be described below simultaneously. In FIG. 1, a portion of the surface layer 4 has been broken away in the top left corner of the covering 2. FIG. 2 is a close-up view of a portion framed by dotted lines in FIG. 1, whilst FIGS. 3 and 4 are sectioned views of FIG. 2, in the rest state and in response to a pressure which has a vertical component.

The term floor covering is intended to be understood to refer to any type of floor covering. This may be a simple carpet, that is to say, a floor covering whose surface-area is between approximately 60 $cm^2$ and a few tens of $m^2$. However, the term floor covering has a much wider meaning and may cover all of the floor of a building or a dwelling, at least in the portions thereof which are intended to be visited by elderly persons. As can be seen in FIG. 1, the surface layer 4 comprises an electrical conductor 12 which extends in several parallel lines over the entire height of the floor covering 2.

In the example described here, the conductor 12 is a single electrical wire having a diameter of approximately 1 mm which is connected to an electrical power supply which is not illustrated. The wire 12 rests in the example described here on a lower portion of the surface layer 4, which electrically insulates it. The wire 12 may or may not be further insulated by a sheath. The diameter of this electrical wire may vary in accordance with the current requirements and the supply options envisaged. This single electrical wire may be replaced by a plurality of wires which are electrically insulated from each other and which are each connected to an independent electrical supply. It may also be a conductor system, for example, of the monoconductor or multiconductor printed circuit type, or the like. It may also be a conductive layer which covers the lower portion of the surface layer 4. It may also be a plurality of push-buttons.

As will be seen below, the conductor 12 performs the function of becoming deformed under pressure in a substantially vertical direction in order to establish a local electrical contact which allows this pressure to be detected.

The intermediate layer 6 is located directly below the surface layer 4, in contact with the electrical conductor 12. In the example described here, the intermediate layer 6 is produced from an electrically insulating material, for example, a layer of insulating plastics material.

The intermediate layer 6 comprises a multiplicity of holes 14 which allow the base layer 8 to appear in FIGS. 1 and 2.

The holes 14 are through-recesses which are formed in a regular manner in the intermediate layer 6. In the example described here, these recesses have a circular shape with a radius of 1 cm. In other embodiments, the shape of these recesses may vary and may, for example, be a rectangle, a lozenge, or any other suitable polygon, or any closed contour, in particular formed by means of revolution. The recess has a surface which is selected to be between 2 $cm^2$ and 9 $cm^2$, for a thickness of the intermediate layer of between approximately 3 mm and 12 mm.

Consequently, the recesses 14 are provided to allow the deformation of the layer 4 through them so that the conductor moves into the vicinity of and/or into contact with (adjacent to) the base layer 8. The portion of the conductor 12 which moves into the vicinity of and/or into contact with the base layer 8 forms a conductor segment.

As can be seen in FIGS. 3 and 4, the base layer 8 has a plurality of electrical contacts 16 which are each connected by means of a wire 18 to the electronic controller 10.

In the example described here, the electrical contacts 16 of the base layer 8 are selected to have a contact surface 3 to 5 times greater than the contact surface of an electrical conductor 12 of the surface layer 4. This facilitates the contact therewith during a deformation of the surface layer 4 following a pressure, and prevents detection errors. However, in different variants, the cross-section of the electrical contact 16 may be able to be selected to be identical to that of the electrical conductor 12, or less than it.

In the example described here, the surface layer 4 is superimposed on the intermediate layer 6, which is itself superimposed on the base layer 8, in this order.

The coating 2 is therefore provided to be deposited with the base layer 8 in contact with the ground and with the surface layer 4 as a contact surface for walking. To this end, the surface layer 4 may advantageously be of linoleum, a plastics tile, a carpet or any other type of floor surface as defined by sanitary standards.

Advantageously, the surface layer 4 may be selected to be less hard than the intermediate layer 6, which may, for example, have a pressure resistance of approximately from 15 $kg/cm^2$ to 25 $kg/cm^2$. In this manner, the surface layer 4 may become deformed more readily inside the recesses 14 under the effect of pressure, which allows the detection sensitivity to be increased.

In the same manner, the base layer 8 is suitable for acting as a connection to the ground, and to be, for example, of rubber if the covering 2 is a carpet, or to be a material which is suitable for adhesion or another fixing method if it is a covering for an entire room.

Besides being superimposed, the layers 4, 6 and 8 are specifically arranged so that the conductor 12 is arranged opposite all the recesses 14 or at least the vast majority thereof, and so that the electrical contacts 16 are themselves opposite all these recesses 14 or the vast majority thereof.

In this manner, as illustrated in FIG. 4, when a pressure represented by an arrow in this Figure, for example, the force applied by the weight of a person, is applied to the surface layer 4, it becomes deformed and fills the recesses in the region of the location where this pressure is applied, and the conductor 12 comes into contact with the electrical contacts 16 in the relevant recesses 14.

In the example described here, the recesses 14 are spaced apart vertically and horizontally, from centre to centre, by a distance of approximately 7.5 cm and if a covering having a surface of 1.6 m by 2.1 m is considered, 252 detection locations are therefore obtained, which are formed by the three members comprising the conductor 12, recess 14, contact 16. Advantageously, the spacing between the recesses 14 may be between 5 cm and 20 cm.

When a person falls, he is necessarily in an extended position on his back, on the stomach, or at least with a quite extensive portion of his body on the ground. As each of these detection locations is connected to the electronic controller 10 by a wire 18, it becomes easy to monitor the activity in order to detect any fall. A sufficiently tight mesh thus allows the difference to be detected between a fall and the presence of one or more persons walking on the covering 2.

Furthermore, the mesh of the example described here is also very tight, which provides a high level of precision.

The extent of a person lying down signifies that it is possible to detect a fall:

- when more than ten detection locations are activated in a square having a side of approximately 30 cm, or in a rectangle which has a similar surface-area and whose diagonal line is approximately 35 cm long, or over a surface-area of approximately 0.09 $m^2$, for a minimum length of time, for example, in the order of one minute, or
- when 4 detection locations which are aligned horizontally, diagonally or vertically are activated for a minimum period of time, for example, in the order of one minute.

Generally, the minimum period of time for the detection may be selected to be greater than 15 seconds. In a variant, the detection may not be dependent on a minimum period of time.

These scenarios exclude the case of walking or the presence of several people on the coating 2. This is because an adult foot in the vast majority of cases has a length of less than 35 cm, which corresponds to a shoe size 53. Consequently, the detection criteria described above allow the upright position to be discriminated, in which only the feet are in contact with the ground. Furthermore, when several people are present, even if they are very close, they will not bring about any detection owing to the meshes described, even if the centre-to-centre distance of the recesses 14 is 20 cm.

The calculations required for the detection may be carried out within the electronic controller 10. To this end, it may comprise a calculation unit in the form of an on-board device, a dedicated card or any other appropriate means. The electronic controller 10 may also comprise wired communication means (via conventional telephone line or via a network, for example, Ethernet), or wireless communication means (via a GSM, GPRS, 3G or WiFi communication interface).

Furthermore, the electronic controller 10 may be produced in several portions. In this instance, the electronic controller 10 comprises a first portion 20 which is connected to the wires 18, and which comprises a communication interface which is similar to that described above.

The portion 20 communicates with a remote portion 22 which can carry out the detection calculations mentioned above, and which may itself comprise a communication interface similar to the one described above.

These communication interfaces may be used in order to transmit alerts in the event of a fall being detected, for example, to a central telesurveillance station, to an assistance call centre, to the nursing station in the case of a hospital, a clinic or a retirement home, etcetera.

Finally, the electronic controller 10 may include only a communication interface which is similar to the one described above, all of the calculations for the detection of a fall being remote on a detection server to which the electronic controller 10 is connected via this interface.

FIG. 5 shows an example of a flow chart that the electronic controller 10 can carry out in order to detect falls.

In an operation 20, the electronic controller 10 is initialised, with all the parameters connected with the detection of falls, and with the initialisation of the communication interface.

Then, in an operation 25, a detection loop begins. This loop comprises the detection of the electrical signals in the wires 18. When no pressure is detected, the wires 18 do not have any electrical signal.

If an electrical signal is detected in a specific wire 18, this means that the conductor 12 is in contact with an electrical contact 16. In response to this detection, an identifier of the detection location associated with the given wire 18 is stored, with a time marker.

Then, in an operation 30, the calculation unit verifies the list of identifying pairs of the wire/time marker in order to determine whether these verify one of the conditions for the detection of a fall set out above.

If this is the case, the communication interface is activated in an operation 35 in order to send a fall detection signal, then the detection continues with the operation 25. If not, the loop continues directly with the operation 25.

The sending of the fall detection signal may comprise all the useful information, including the location of the covering 2 if it is known, a time period associated with the time markers in order to indicate the time of the fall, etcetera.

As mentioned above, the invention may be applied both to carpets and complete floor coverings, in order to equip an entire hospital or a retirement home, for example, and is based on the conversion of a pressure connected with a fall into an electrical signal whose location is known, in order to detect a fall.

In a different number of variants, the covering may have the following features:

- the electronic controller comprises a calculation unit which is capable of detecting a fall in accordance with the signal transmitted over the electrical wires which are connected to the electrical contacts,
- the calculation unit is arranged so as to detect:
  - the activation of more than ten detection locations in a surface-area of approximately 0.09 $m^2$, for a period of time greater than or equal to 30 seconds, and/or
  - the activation of four detection locations which are aligned horizontally, diagonally or vertically for a period of time greater than or equal to 30 seconds,
- the electronic controller further comprises a communication interface which is capable of selectively transmitting the detection signal,
- the communication interface is of the wired type,
- the communication interface operates with a conventional telephone network,
- the communication interface operates with an Ethernet network,
- the communication interface is of the wireless type,
- the communication interface operates with a wireless telephone network of the type GMS, GPRS or 3G, and
- the communication interface operates with a wireless network of the WiFi type.

The invention claimed is:

1. A floor covering, comprising:

a surface layer which comprises a plurality of conductive segments which are capable of being supplied with electrical power;

an intermediate layer which is at least partially electrically insulating and which comprises a plurality of through-recesses which are distributed in a substantially regular manner so that a mean distance between a recess and an adjacent recess which is closest is between approximately 5 cm and 20 cm;

a base layer which comprises a plurality of electrical contacts, of which at least some correspond to recesses of the intermediate layer and which are connected to an electronic controller; and a fall detector capable of detecting a fall in accordance with the signal transmitted over electrical wires which are connected to the electrical contacts, wherein the surface layer, the intermediate layer and the base layer being superimposed in this order and positioned so that at least some of the conductive segments are arranged at least partially opposite a recess of the intermediate layer, and so that these conductive segments react to a pressure by approaching corresponding electrical contacts of the base layer, wherein the pressure reaction is a detection and the fall is determined when at least one of:

more than ten detection locations are activated over a surface-area of approximately 0.09 $m^2$, and the activations occur between 15 seconds and 1 minute, and when four detection locations which are aligned in an x-y plane or diagonally are activated and the activations occur between 15 seconds and 1 minute, and wherein the electronic controller further being arranged to selectively transmit a fall warning signal, in accordance with the fall detection.

2. The floor covering according to claim 1, wherein the electronic controller comprises the fall detector.

3. The floor covering according to claim 2, wherein the electronic controller further comprises a communication interface which is capable of selectively transmitting a detection signal.

4. The floor covering according to claim 1, wherein the fall detector is arranged so as to detect at least one of:

the activation of more than ten detection locations in a surface-area of approximately 0.09 $m^2$, for a period of time greater than or equal to 30 seconds, and the activation of four detection locations which are aligned in an x-y plane or diagonally for a period of time greater than or equal to 30 seconds.

5. The floor covering according to claim 4, wherein the electronic controller further comprises a communication interface which is capable of selectively transmitting a detection signal.

6. The floor covering according to claim 1, wherein the electronic controller further comprises a communication interface which is capable of selectively transmitting a detection signal.

7. The floor covering according to claim 6, wherein the communication interface is wired.

8. The floor covering according to claim 7, wherein the communication interface operates with a telephone network.

9. The floor covering according to claim 7, wherein the communication interface operates with an Ethernet network.

10. The floor covering according to claim 6, wherein the communication interface is wireless.

11. The floor covering according to claim 6, wherein the communication interface operates with a wireless telephone network that is Global System for Mobile Communications, General Packet Radio Service, or Third Generation Mobile Telephony.

12. The floor covering according to claim 6, wherein the communication interface operates with a Wi-Fi wireless network.

13. The floor covering according to claim 1, wherein the recesses have a circular shape with a radius of 1 cm.

14. The floor covering according to claim 1, wherein each recess has a surface between 2 $cm^2$ and 9 $cm^2$ for a thickness of the intermediate layer between approximately 3 mm and 12 mm.

15. The floor covering according to claim 1, wherein the surface layer is less hard than the intermediate layer, and has a pressure resistance of approximately 15 $kg/cm^2$ to 25 $kg/cm^2$.

16. The floor covering according to claim 1, wherein the base layer is formed from rubber.

17. The floor covering according to claim 1, wherein a spacing between recesses is approximately 7.5 cm from center to center.

18. The floor covering according to claim 1, wherein the fall detector detects a fall when more than ten detection locations are activated in a square having a side of approximately 30 cm, or in a rectangle which has a similar surface-area and whose diagonal line is approximately 35 cm long, or over a surface-area of approximately 0.09 $m^2$.

* * * * *